US005415792A

United States Patent [19]

Campbell

[11] Patent Number: 5,415,792

[45] Date of Patent: May 16, 1995

[54] OVERBASED ALKYLATED ALKYL SALICYLATES

[75] Inventor: Curtis B. Campbell, Hercules, Calif.

[73] Assignee: Chevron Chemical Company, San Francisco, Calif.

[21] Appl. No.: 173,192

[22] Filed: Dec. 23, 1993

[51] Int. Cl.[6] ..... C10M 129/00

[52] U.S. Cl. ..... 252/18; 252/25; 252/41

[58] Field of Search ..... 252/18, 25, 41; 562/475; 560/67

[56] References Cited

U.S. PATENT DOCUMENTS

| | | | |
|---|---|---|---|
| 2,490,444 | 12/1949 | Kooijman et al. | 260/521 |
| 4,057,504 | 11/1977 | Shiga et al. | 252/33 |
| 4,719,023 | 1/1988 | MacPhail et al. | 252/39 |
| 4,810,398 | 3/1989 | Van Kruchten et al. | 252/40 |
| 5,225,588 | 7/1993 | Senaratne et al. | 560/71 |
| 5,256,320 | 10/1993 | Todd et al. | 252/32.7 E |

FOREIGN PATENT DOCUMENTS

| | | |
|---|---|---|
| 2542732 | 9/1984 | France . |
| 269619 | 7/1989 | Germany . |
| 272065 | 9/1989 | Germany . |
| 54-160335 | 6/1978 | Japan . |
| 2097417 | 11/1982 | United Kingdom . |

OTHER PUBLICATIONS

Croxall et al, "Organic Reactions with Boron Fluoride. VII. The Rearrangement of Isoporpyl Salicylate and the Condensation of Propylene with Salicyclic Acid," *J. Am. Chem. Soc.*, 56, 2054–2055 (1934). (*No month avail.).

Croxall et al, "Organic Reactions with Boron Fluoride. XI. The Condensation of Propylene with *m*-and *p*-Hydroxybenzoic Acids," *J. Am. Chem. Soc.*, 57, 1549–1551 (1935). (No month avail.).

Derwent Abstract No. 89–357182/49 (no month avail).

Derwent Abstract No. 90–067884/10 (no month avail.).

Derwent Abstract No. 08382C/05 (no month avail.).

Derwent Abstract No. 84–265358/43 (no month avail.).

Meyer et al, "Uber die Alkylierung Aromatischer Verbindungen," *Monatsh.*, 53 and 54, 721–52 (1929) (and Chem Abstract vol. 24, pp. 346–347 (1930) abstract). (Month Unknown).

*Primary Examiner*—Prince Willis, Jr.
*Assistant Examiner*—Cephia D. Toomer
*Attorney, Agent, or Firm*—W. K. Turner; L. S. Squires

[57] ABSTRACT

This invention is directed to overbased alkyl alkyl salicylate which are useful additives for lubricating oil compositions. In particular, the compositions of this invention impart detergency and disperancy to the lubricating oil composition as well as provide for alkalinity reserve.

30 Claims, No Drawings

OVERBASED ALKYLATED ALKYL SALICYLATES

BACKGROUND OF THE INVENTION

1. Field of the Invention

This invention is directed to overbased alkylated alkyl salicylates which overbased products are suitable for use in lubricating oil compositions used in internal combustion engines. In particular, these additives impart water tolerance, thermal stability, detergency, compatibility and good oxidation performance in such lubricating oil compositions.

2. State of the Art

Overbased alkylated salicylates are a class of lubricating oil detergents known to impart improved performance (detergency, water tolerance, thermal stability, antioxidancy) to lubricating oil compositions used for lubrication of internal combustion engines.

Overbased salicylates are prepared by overbasing the corresponding alkylated salicylic acids which, in turn, are typically prepared by first alkylating phenol to form alkylphenol followed by carboxylation via the Kolbe-Schmitt reaction to provide for alkylated salicylic acid. The alkyl group is typically a long chain alkyl group of greater than about 14 carbon atoms so as to impart oil solubility.

One problem encountered with this synthetic scheme when a substantially linear alkylation feed is employed is that not all of the long chain alkylphenol is readily carboxylated via the Kolbe-Schmitt reaction. Specifically, conventional alkylation of phenol with a substantially linear alkylation feed provides for approximately a 50:50 mixture of ortho-alkylphenol and para-alkylphenol. While the Kolbe-Schmitt reaction readily carboxylates the resulting long chain para-alkylphenol, the resulting long chain ortho-alkylphenol is less reactive and only about 70 percent of total amount of the alkylphenol derived from a substantially linear alkylation feed is typically converted to alkylated salicylic acid during this reaction.

One method of circumventing this problem is to alkylate an alkyl salicylate (e.g., methyl salicylate) and then subject the resulting alkylated alkyl salicylate to hydrolysis so as to provide for the alkylated salicylic acid. Methods of alkylating alkyl salicylates are disclosed in U.S. patent application Ser. No. 08/72,544, filed concurrently herewith and entitled "ALKYLATION OF ALKYL SALICYLATE USING A LONG CHAIN CARBON FEED" which application is incorporated herein by reference in its entirety.

This latter synthetic scheme involves formation of an alkyl salicylate, alkylation of the alkyl salicylate to form an alkylated alkyl salicylate, followed by hydrolysis to form the alkylated salicylic acid. Hydrolysis of the alkylated alkyl salicylate to form alkylated salicylic acid was perceived necessary to later formation of overbased products since the carboxyl (—COOH) group was deemed to be an essential component during overbasing. Specifically, overbased products are prepared by the addition of excess basic metal (i.e., greater than that required to neutralize all of the acidic species on the salicylic acid) optionally using carbon dioxide and it was considered that the carboxyl group played an essential role in the ability of the alkylated salicylic acid to incorporate excess basic metal and carbon dioxide presumably via chelation.

This invention is directed, in part, to the discovery that alkylated alkyl salicylates can be overbased without hydrolysis of the ester functionality to provide for overbased lubricating oil additives suitable for use in lubricating oil compositions. This discovery is particularly surprising in view of the fact that the overbased products of this invention lack carboxyl (—COOH) functionality but, rather, possess an ester (—COOR) functionality (R being alkyl of from 1 to 6 carbon atoms).

SUMMARY OF THE INVENTION

This invention is directed, in part, on the discovery that alkylated alkyl salicylates can be directly overbased without hydrolysis of the ester and such overbased products provide for a new class of lubricating oil additives, which exhibit detergency, a source of alkaline reserve, etc. in the finished lubricating oil composition.

Accordingly, in one of its composition aspects, this invention is directed to a lubricating oil soluble, overbased alkylated alkyl salicylate additive composition having a TBN of from greater than 0 to about 300.

In another of its composition aspects, this invention is directed to a lubricating oil soluble, overbased alkylated alkyl salicylate composition which is prepared by the process which comprises:

(a) combining into a diluent from about 15 to about 50 weight percent of an alkylated alkyl salicylate based on the total weight of the alkylated alkyl salicylate/diluent composition wherein said alkylated alkyl salicylate is of the formula

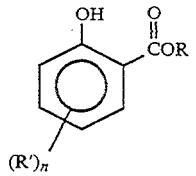

where R is alkyl of from 1 to about 6 carbon atoms; R′ is an alkyl group of from about 15 to about 50 carbon atom; and n is an integer from 1 to 2;

(b) combining a sufficient amount of an alkaline earth metal base into the composition produced in (a) above under conditions wherein the amount of alkaline earth metal is incorporated into the salicylate in excess of that necessary to neutralize the alkylated alkyl salicylate; and (c) optionally contacting from about 0.1 to about 1.5 molar equivalents of carbon dioxide based on each molar equivalent of alkylated alkyl salicylic acid under conditions wherein carbon dioxide is incorporated into the composition wherein the overbased composition has a TBN of from greater than 0 to about 300.

In still another of its composition aspects, this invention is directed to a lubricating oil composition comprising an oil of lubricating viscosity and from about 2 to about 30 weight percent of an overbased alkylated alkyl salicylate additive composition having a TBN of from greater than 0 to about 300.

DETAILED DESCRIPTION OF THE PREFERRED EMBODIMENTS

This invention is directed to novel overbased alkylated alkyl salicylate compositions which are useful additives for lubricating oil compositions. However, prior to discussing this invention in detail, the following terms will first be defined:

Definitions

As used herein, the term "Total Base Number" or "TBN" refers to the amount of base equivalent to milligrams of KOH in 1 gram of additive. Thus, higher TBN numbers reflect more alkaline products and therefore a greater alkalinity reserve. The Total Base Number for an additive composition is readily determined by ASTM test method number D2896 or other equivalent methods.

The term "alkaline earth metal" or "Group II metal" means calcium, barium, magnesium, and strontium. Preferably, the Group II metal is selected from the group consisting of calcium, magnesium, barium, and mixtures thereof. Most preferably, the Group II metal is calcium.

The term "alkaline earth metal base" refers to basic alkaline earth metal materials suitable for use in preparing overbased alkylated alkyl salicylates and, include by way of example, alkaline earth metal oxides, hydroxides and $C_1$ to $C_6$ alkoxides.

The term "alkyl salicylates" refers to compounds of the formula:

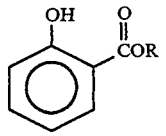

wherein R is an alkyl group of from 1 to 6 carbon atoms. Preferably, R is an alkyl group of from 1 to 3 carbon atoms and most preferably R is methyl.

The term "alkylated alkyl salicylate" refers to alkyl salicylates which have been alkylated with a long chain carbon feed which alkylated products can be represented by the formula:

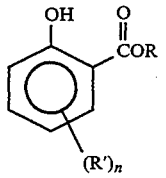

where R is as defined above; R' is an alkyl group of from about 15 to 50 carbon atoms; and n is an integer of from 1 to 2 and is preferably 1. In a preferred embodiment, the amount of dialkylation in the product is maintained to about 5% or less.

The term "overbased alkylated alkyl salicylate compositions" refers to compositions prepared by reacting an alkylated alkyl salicylate with an amount of alkaline earth metal base in excess of that necessary to neutralize the acidic species on the alkylated alkyl salicylate and optionally with carbon dioxide. Such overbased products are characterized as having a TBN of greater than 0 and preferably no more than about 300.

The overbased alkylated alkyl salicylate compositions described herein can contain diluent and the term "overbased alkylated alkyl salicylate compositions" is meant to include compositions containing such diluent. Typically, such compositions are manufactured to contain some diluent and, after manufacture, the diluent can be removed, replaced or additional amounts of diluent can be added to provide for an additive composition preferably having from 0 to about 40 weight percent diluent. As such, these additive compositions contain concentrated amounts of the overbased alkylated alkyl salicylate of which only a small amount is added together with other additives to a lubricating oil so as to provide for a fully formulated lubricant composition suitable for use in an internal combustion engine.

The term "substantially straight-chain alkyl group" means an alkyl group which is attached to the benzene ring of the alkyl salicylate through a secondary, tertiary or quaternary carbon atom and which contains minimal branching in the remainder of the carbon atoms of the alkyl group (i.e., less than 20% of the remaining carbon atoms are tertiary and/or quaternary carbon atoms in the molecular structure of the alkyl group). Suitable substantially straight-chain alkyl groups include, for example, 1-hexadecyl—$[CH_2(CH_2)_{14}CH_3]$ (0% of the carbon atoms are tertiary or quaternary carbon atoms), 4-methyl-1-hexadecyl—$[CH_2(CH_2)_2CHCH_3(CH_2)_{11}CH_3]$ (<7% of the carbons are branched), etc.

Preferably, the substantially straight-chain alkyl group contains less than 15% tertiary and/or quaternary carbon atoms in the remainder of the alkyl group; more preferably, less than 10%; still more preferably, less than 5%; and most preferably, the substantially straight-chain alkyl group contains no tertiary or quaternary carbon atoms in the remainder of the alkyl group.

The term "oil solubility" means that the additive has a solubility of at least 50 grams per kilogram and preferably at least 100 grams per kilogram at 20° C. in a base 10W40 lubricating oil.

Methodology

In the method of the present invention, alkylated alkyl salicylate is overbased with an excess amount of an alkaline earth metal base (e.g., alkaline earth metal oxide, hydroxide or $C_1$ to $C_6$ alkoxide) and optionally with carbon dioxide.

Specifically, in the methods of this invention, alkaline earth metal base is combined with the alkylated alkyl salicylate under conditions wherein the amount of such base employed is that which is in excess of that necessary to neutralize the acidic species on the alkylated alkyl salicylate and optionally carbon dioxide is also employed to further enhance the basicity of the overbased product. Such overbased products are characterized as having a TBN of greater than 0 and preferably no more than about 300.

The reaction is preferably conducted in an inert diluent under conditions wherein the alkaline earth metal base is incorporated into the alkylated alkyl salicylate. Preferably, the reaction is conducted at a temperature of from about 20° C. to about 100° C. and is preferably complete within a period of from about 0.2 to about 5 hours. The amount of alkylated alkyl salicylate employed is preferably from about 5 to about 50 weight percent based on the total of diluent and alkylated alkyl salicylate employed and more preferably from about 15 to about 50 weight percent.

Without being limited to any theory, I believe that the alkaline earth metal base is incorporated through the hydroxyl group of the salicylate and that the carbonyl group of the ester participates in facilitating this incorporation.

The amount of alkaline earth metal base which can be practically incorporated into alkylated alkyl salicylate is generally limited to products having a TBN of greater than 0 and less than about 100 and preferably less than about 50. While such products are nevertheless overbased products, the preparation of products having a TBN of greater than about 100 requires the further use of carbon dioxide. Also, carbon dioxide can be employed but is not necessary in the preparation of overbased compositions having a TBN of from greater than 0 to about 100.

Preferably, the amount of alkaline earth metal base employed is from about 0.6 to about 2.5 molar equivalents based on the amount of alkylated alkyl salicylate employed. At this range, the alkaline earth metal base is in excess over that which is necessary to neutralize all of the acidic species on the alkylate alkyl salicylate.

In general, from about 0.1 to about 1.5 molar equivalents of carbon dioxide to the alkaline earth metal base and preferably from about 0.5 to about 1.25 molar equivalents, are then added to the reaction mixture via conventional methods after alkaline earth metal incorporation and the carbonation step is preferably conducted at from about 20° to about 80° C.

After reaction completion, the solids are generally removed by conventional means (i.e. filtration, centrifugation, etc.) and the inert diluent solvent can be removed by conventional means such as stripping under reduced pressure.

When carbon dioxide is not employed, the inert diluent is preferably 2-ethylhexanol and diluent oil but a mixture of an alkanol of from 1 to 3 carbon atoms and an aromatic solvent having a boiling point less than about 150° C. can also be employed.

When carbon dioxide is employed, the inert diluent is preferably a mixture of an alkanol of from 1 to 3 carbon atoms and an aromatic solvent having a boiling point of less than about 150° C.

Suitable alcohols include methanol, ethanol, n-propanol and iso-propanol. Suitable aromatic solvents having a boiling point of less than about 150° C. include, by way of example, benzene, toluene, xylene, chlorobenzene and the like. The diluent preferably comprises from about 5 to about 30 weight percent of the alkanol of from 1 to 3 carbon atoms and from about 95 to about 70 weight percent of the aromatic solvent. A particularly preferred diluent is a mixture methanol and toluene preferably at a weight ratio of 20 to 80.

Other components can be included in the diluent such as lubricating oil base stock.

In one preferred embodiment, the diluent does not contain a lubricating oil base stock and, after reaction completion, substantially all diluent is stripped from the overbased product to provide for a fluid product having a viscosity of less than about 1000 cSt at 100° C. and preferably less than 500 cSt at 100° C.

In another preferred embodiment, lubricating oil base stock is included during preparation of the overbased product and, after product preparation, the alkanol and aromatic solvent are removed by stripping.

In still another preferred embodiment, the reaction is conducted in the absence of lubricating oil base stock and, after product preparation, the base stock is added either before or after the alkanol and aromatic solvent are removed by stripping.

In either of the latter two cases, the resulting composition comprises a concentrate of the overbased alkylated alkyl salicylate in a base stock which is suitable for use in directly formulating a lubricating oil composition. When so employed, the amount of lubricating oil base stock included in the concentrate comprises from about 5 to about 95 weight percent base stock and from about 95 to about 5 weight percent overbased alkylated alkyl salicylate.

The alkylated alkyl salicylates used in the preparation of overbased alkylated alkyl salicylates can be prepared by methods known in the art such as that described in Deutsche Patentschrifts DD 269 619 and DD 272,065 as well as Japanese Patent Application No. 54/160335 which methods employ an excess of alkyl salicylate to the alkylating agent (e.g., olefin) or an excess of alkylating agent to the alkyl salicylate. The alkylated alkyl salicylates, however, are preferably prepared by the methods described in U.S. patent application Ser. No. 08/72,544, filed concurrently herewith and entitled "ALKYLATION OF ALKYL SALICYLATE USING A LONG CHAIN CARBON FEED" and which are further described in Example 2 below.

Preferably, the alkylated alkyl salicylate is alkylated with substantially straight-chain olefins. Particularly preferred alkylating olefins include substantially straight-chain $C_{20}$–$C_{28}$ olefins, substantially straight-chain $C_{20}$–$C_{24}$ olefins, and substantially straight-chain $C_{24}$–$C_{28}$ olefins.

Utility

The oil-soluble, overbased alkylated alkyl salicylate compositions described above are useful lubricating oil additives imparting detergency and dispersency properties when added to the lubricating oil employed in the crank case of an internal combustion engine as well as an alkaline reserve which is essential to neutralize acidic combustion products produced during engine operation. Such lubricating oil compositions are useful in diesel engines, gasoline engines as well as in marine engines. When employed in this manner, the amount of oil-soluble, neutral and low overbased alkyl methyl salicylate added to the lubricating oil composition ranges from about 0.5 to 40 weight percent of the total lubricant composition although preferably from about 2 to 30 weight percent of the total lubricant composition.

Such lubricating oil compositions employ a finished lubricating oil which may be single or multigrade. Multigrade lubricating oils are prepared by adding viscosity index (VI) improvers. Typical viscosity index improvers are polyalkyl methacrylates, ethylene, propylene copolymers, styrene-diene copolymers, and the like.

The lubricating oils used in such compositions may be mineral oils or synthetic oils of viscosity suitable for use in the crank case of an internal combustion engine such as gasoline engines and diesel engines which include marine engines. Crank case lubricating oils ordinarily have a viscosity of about 1300 cSt at 0° F. to 24 cSt at 210° F. (99° C.). The lubricating oils may be derived from synthetic or natural sources. Mineral oils for use as the base oil in the invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of $\alpha$-olefins having the proper viscosity. Especially useful are the hydrogenated liquid oligomers of $C_6$ to $C_{12}$ alpha olefins such as 1-decene trimer. Likewise, alkylbenzenes of proper viscosity such as didodecyl benzene, can be used. Useful synthetic esters include esters of both monocarboxylic acids and polycarboxylic acids as well as monohydroxy alkenols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Other additives which may be present in the formulation include rust inhibitors, foam inhibitors, corrosion inhibitors, metal deactivators, pour point depressants, anti-oxidants, and a variety of other well-known additives.

The invention will be illustrated in greater detail by the following specific examples. It is understood that these examples are given by way of illustration only and are not meant to limit the disclosure of the claims to follow.

EXAMPLES

Example 1

Preparation of Alkylated Methyl Salicylate Using 1:5 Molar Ratio of Olefin to Methyl Salicylate Methyl salicylate (from Aldrich Chemical Company, Milwaukee, Wis. USA) was alkylated with a $C_{20}$–$C_{24}$ olefin carbon feed at a molar ratio of 5:1 of methyl salicylate to carbon feed. In this example, 1802.6 grams of a $C_{20}$–$C_{24}$ olefin fraction (available from Chevron Chemical Corporation, San Francisco, Calif.), was charged to a 5 liter, four-neck oven dry flask. 2457.5 grams of methyl salicylate followed by 591.3 grams of AMBERLYST ®36 sulfonic acid resin (available from Rohm and Haas, Philadelphia, Pa. USA) were next charged to the flask. The flask was then equipped with a stiffer, temperature probe with controller, reflux condensor and a nitrogen blanket.

The reaction mixture was heated to a temperature of 125° C. over a period of 50 minutes and held at that temperature for approximately 48 hours. After 48 hours, about 94.2% conversion of the methyl salicylate to alkyl methyl salicylate had occurred. The reaction mixture was cooled with stirring overnight to a temperature of about 50° C.

The crude alkyl methyl salicylate was removed from the reaction flask by using a gas dispersion tube and pulling it into a four liter flask under vacuum. The catalyst remained in the reaction flask. Product remaining on the catalyst was removed by rinsing the contents of the flask with approximately 400 ml portions of toluene while stirring, followed by pulling the toluene and crude product into a two liter flask through a gas dispersion tube under vacuum. This rinsing/pulling procedure was repeated additional three times. The toluene recovered in this procedure was stripped on a rotovap at a temperature of approximately 95° C. to 100° C. under vacuum (~25 mm of Hg vacuum) and the resulting stripped product was combined with the recovered crude alkylated methyl salicylate.

The combined crude alkylated methyl salicylate was then stripped at a temperature of about 130° C. at a pressure of approximately 1 to 10 mm of mercury. Further stripping was conducted at a temperature of about 185° C. to 191° C. at a pressure of approximately 1 to 10 mm of mercury. Product analysis indicated that about 94.7 weight percent of the methyl salicylate was alkylated.

Example 2

Preparation of Alkyl Methyl Salicylate Using 1:1 Molar Ratio of Olefin to Methyl Salicylate Methyl salicylate commercially obtained from Aldrich Chemical Company, Milwaukee, Wis. USA was alkylated using a long chain carbon feed. In this example, 617.9 grams (2.0 moles) of a $C_{20}$–$C_{24}$ alpha olefin fraction (available from Chevron Chemical Corporation, San Francisco, Calif.), was charged to a 2 liter, three-neck oven dry flask. 304.3 grams (2 moles) of methyl salicylate, followed by 150 grams of AMBERLYST ®36 (a solid acidic sulfonic acid resin catalyst commercially available from Rohm & Haas, Philadelphia, Pa. USA), were next charged to the flask. The flask was then equipped with a stirrer, temperature probe with controller, reflux condensor and a nitrogen blanket.

The reaction mixture was heated to a temperature of 135° C. over a period of 25 minutes and held at that temperature for approximately 61 hours while periodically removing aliquots to check reaction completion. After 61 hours, the recovered product was analyzed for its components which analysis is reported in Table I below:

TABLE I

| COMMNENTS IN RECOVERED ALKYLATED METHYL SALICYLATE | |
|---|---|
| COMPONENT | WEIGHT PERCENT |
| salicylic acid | 1.5% |
| olefin | 6.5% |
| alkyl methyl salicylate | 87.5% |
| methyl salicylate | 4.5% |

The product was filtered through a sintered glass filter. The filtered alkyl methyl salicylate was heated to a temperature of 210° C. over a period of about 45 minutes and then stripped under vacuum of about 1 to 10 mm of Hg was applied. These stripping conditions were maintained for about 30 minutes, The stripped product was next cooled to 150° C. and the vacuum broken with a nitrogen stream, 739,9 grams of product was recovered, Analysis of this product is set forth in Table II below:

TABLE II

| COMPONENTS IN RECOVERED AND STRIPPED ALKYLATED METHYL SALICYLATE | |
|---|---|
| COMPONENT | WEIGHT PERCENT |
| salicylic acid | 0.1% |
| olefin | 4.7% |
| alkyl methyl salicylate | 95.2% |

Example 3

Preparation of Overbased Alkyl Methyl Salicylate Additive Composition in the Absence of Carbon Dioxide Alkyl methyl salicylate produced in the manner similar to either Example 1 or 2 above is overbased with an excess of calcium hydroxide. In this example, 100 grams of $C_{20}$–$C_{24}$ alkylated methyl salicylate is combined into approximately 500 ml of 2-ethylhexanol at room temperature. About 20 grams of lime are added to the solution and the solution is maintained at about 30° C. for about 2 hours. Afterwards, the 2-ethylhexanol diluent is removed by stripping to provide for an overbased alkylated alkyl salicylate having a TBN of greater than zero and less than about 100.

Example 4

Preparation of Overbased Alkyl Methyl Salicylate Additive Composition Containing Carbon Dioxide To a 2 liter, 4-neck round bottom flask were added 100 grams of methanol, 480 grams of xylene, and 90 grams of Mississippi Lime (Mississippi Lime Company, Ste. Genevieve, Mo.) The resulting system was stirred for 10 minutes. Afterwards, 266 grams of alkyl methyl salicylate, prepared in a manner similar to that of Examples 1 and 2, was slowly added to the system, over about a 1.5 hour period, while maintaining a maximum temperature of 31 ° C.

At this point, carbonation was initiated and approximately 28 grams of carbon dioxide were added at the following rates:

17.5 grams $CO_2$ at 0.295 grams/minute
2.4 grams $CO_2$ at 0.224 grams/minute
2.8 grams $CO_2$ at 0.183 grams/minute
2.8 grams $CO_2$ at 0.140 grams/minute
2.8 grams $CO_2$ at 0.061 grams/minute Upon completion of the carbonation step, the system was heated to 93° C. over a 2 hour period and then heated to 132° C. over a 30 minute period. At this point, 155 grams of diluent oil, CitCon 100N, was added and the system heated to 204° C. over 1.5 hours under vacuum to strip of the xylene. The resulting solution was then filtered over Celite TM (diatomaceous earth available from Manville Corporation) so as to provide an overbased carbon dioxide containing alkyl methyl salicylate additive composition having a TBN of about 182 and a viscosity at 100° C. of about 19 cSt.

Proton nuclear magnetic resonance spectroscopy ($^1$H-nmr) and infrared spectroscopy of the resulting composition indicated the retention of the methyl ester in the overbased product.

Example 5

Dispersion Test

Overbased alkylated alkyl salicylate prepared in Example 4 above was tested for dispersancy in the following dispersion test. In this test, the dispersant ability of the formulated lubricating oil composition is obtained by conducting chromatography on paper of a mixture of the lubricating oil composition to be tested and an artificial sludge under the following conditions:

| | |
|---|---|
| Spot No. 1 | Ambient temperature without water |
| Spot No. 2 | 10 minutes at 200° C. without water |
| Spot No. 3 | 10 minutes at 250° C. without water |
| Spot No. 4 | Ambient temperature with 1% water |
| Spot No. 5 | 10 minutes at 200° C. with 1% water |
| Spot No. 6 | 10 minutes at 250° C. with 1% water |

The spots are rated after 48 hours. For each spot, the diameters of diffusion of soot (d) and of the oil (D) are measured and the ratio is calculated. The disperancy of the oil over a variety of conditions is obtained from the sum of the six spot ratings. Oils having values of greater than about 250 are considered to have dispersant properties and are compared to reference oils, i.e., an oil having 23.4 weight percent of commercially available salicylate under otherwise identical parameters.

The lubricating oil composition was prepared by combining 22 weight percent of an overbased alkylated alkyl salicylate similar to that of Example 4 above, 0.67 weight percent of a zinc dithiophosphate and 1.60 weight percent of an alkenyl succinimide to a SAE 30 oil. The resulting composition has 1.505 weight percent calcium, 0.080 weight percent zinc; 0.050 weight percent phosphorus; 0.03 weight percent nitrogen; a TBN of about 40.2; and a viscosity at 100° C. of 11.8 cSt.

20 grams of this test composition were then combined with 5 grams of sludge containing 2 % of carbonaceous material. The mixture is then homogenized. In the samples containing water, 1% water (250 μl) is added to the composition prior to homogenizing.

The freshly homogenized test lubricating oil composition (20 μl of each but done in duplicate) are syringed onto 2 separate sheets of paper using a 100 μl syringe. The heated samples are first incubated in a heating bath at the indicated temperature for 10 minutes before application.

The papers are stored in the horizontal position for 48 hours at a temperature of from about 20° to about 25° C. Storage is conducted under conditions to shelter the papers from dust.

After 48 hours, the spots should be circular and the zone of dispersion of the soot (d) as well as the zone of the dispersion of the oil (D) are measured. For additives providing good dispersancy, the sum of the six values of $d/D \times 100$ should be at least 250. In the present case, the sum was 312. This indicates that the salicylates of this invention possess dispersant properties. Additionally, comparison to reference oil indicates similar properties, i.e., the sum of these 6 spots for the reference oil was 332.

Example 6

Hydrolytic Stability Test

Overbased alkylated alkyl salicylate prepared in Example 4 was tested for its hydrolytic stability. The test comprises preparing a formulated lubricating oil composition wherein the TBN is derived primarily from the overbased alkylated alkyl salicylate composition. In the present case, the tested lubricant compositions were formulated with 1 weight percent of a succinimide dispersant and 8 mmoles of a ZnDTP containing secondary alkyl groups in a base stock which was additionally formulated with 22 weight percent of the alkylated alkyl salicylate so as to provide for a TBN of about 40.

In this test, 98 grams of the formulated lubricating oil composition and 2 grams of distilled water are combined and sealed in a pressure type beverage bottle. The bottle is rotated end over end for about 70 hours in a convention oven maintained at about 93° C. The bottles are then cooled to room temperature and the contents thereof are poured into a centrifuge tube and spun at 10,000 rotations per minute for about 60 minutes at room temperature. The TBN of the oil layer is then determined and loss of TBN relates to the hydrolytic stability of the lubricant oil composition—the greater the loss of TBN the less hydrolytically stable the lubricant oil composition was.

In this test, the resulting TBN loss was 3 % which reflected that these compositions were hydrolytically stable. Additionally, the amount of filtered deposits was 0.09% which indicated little formation of solid residues upon exposure to water.

While the invention has been described in terms of various preferred embodiments, the skilled artisan will appreciate that various modifications, substitutions, omissions, and changes may be made without departing from the spirit thereof. Accordingly, it is intended that the scope of this invention be limited solely by the scope of the following claims, including equivalents thereof.

What is claimed is:

1. A lubricating oil soluble overbased alkylated alkyl salicylate additive composition having a TBN of from greater than 0 to about 300 comprising an alkaline earth metal overbased alkylated alkyl salicylate ester wherein said overbased ester has the formula prior to overbasing of:

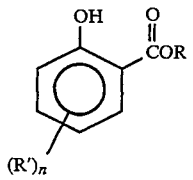

wherein R is alkyl of from 1 to about 6 carbon atoms; R′ is an alkyl group of from about 15 to 50 carbon atoms; and n is an integer of from 1 to 2; after overbasing said alkylated alkyl salicylate ester retains its ester functionality and is substantially free of its carboxyl functionality and a diluent.

2. The composition according to claim 1 wherein R is methyl and R′ is an alkyl group of from about 20 to about 50 carbon atoms.

3. The composition according to claim 1 wherein R′ is a mixture of $C_{20}$–$C_{24}$ alkyl groups.

4. The composition according to claim 1 wherein said overbased alkylated alkyl salicylate has a TBN of from greater than 0 to about 100.

5. The composition according to claim 1 wherein said overbased alkylated alkyl salicylate has a TBN of from greater than about 100 to about 300.

6. The composition according to claim 1 which further comprises from about 5 to 95 weight percent of a diluent oil.

7. A lubricating oil soluble, overbased alkylated alkyl salicylate composition which is prepared by the process which comprises:

(a) combining into a diluent from about 15 to about 50 weight percent of an alkylated alkyl salicylate based on the total weight of the alkylated alkyl salicylate/diluent composition wherein said alkylated alkyl salicylate is of the formula

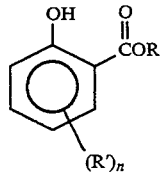

where R is alkyl of from 1 to about 6 carbon atoms; R′ is an alkyl group of from about 15 to about 50 carbon atom; and n is an integer of from 1 to 2;

(b) combining a sufficient amount of an alkaline earth metal base into the composition produced in (a) above under conditions wherein the amount of alkaline earth metal is incorporated into the salicylate in excess of that necessary to neutralize the alkylated alkyl salicylate; and (c) optionally contacting from about 0.1 to about 1.5 molar equivalents of carbon dioxide based on each molar equivalent of alkylated alkyl salicylic acid under conditions wherein carbon dioxide is incorporated into the composition wherein the overbased composition has a TBN of from greater than 0 to about 300.

8. The composition according to claim 7 wherein the alkaline earth metal base is selected from the group consisting of an alkaline earth metal oxide, hydroxide, and $C_1$ to $C_6$ alkoxide.

9. The composition accordingly to claim 8 wherein the alkaline earth metal base is calcium hydroxide.

10. The composition according to claim 7 wherein R is methyl and R′ is an alkyl group of from about 20 to about 50 carbon atoms.

11. The composition according to claim 10 wherein R′ is a mixture of $C_{20}$–$C_{24}$ alkyl groups.

12. The composition according to claim 7 wherein said overbased alkylated alkyl salicylate is prepared in the absence of carbon dioxide wherein said composition has a TBN of greater than 0 and less than 100.

13. The composition according to claim 12 wherein said overbased alkylated alkyl salicylate has a TBN of greater than 0 and less than 50.

14. The composition according to claim 7 wherein said overbased alkylated alkyl salicylate is prepared using carbon dioxide.

15. The composition according to claim 7 which further comprises from about 5 to 95 weight percent of a diluent oil.

16. A lubricating oil composition comprising an oil of lubricating viscosity and from about 2 to about 30 weight percent of an overbased alkylated alkyl salicylate additive composition according to claim 1.

17. A lubricating oil composition comprising an oil of lubricating viscosity and from about 2 to about 30 weight percent of an overbased alkylated alkyl salicylate additive composition according to claim 2.

18. A lubricating oil composition comprising an oil of lubricating viscosity and from about 2 to about 30 weight percent of an overbased alkylated alkyl salicylate additive composition according to claim 3.

19. A lubricating oil composition comprising an oil of lubricating viscosity and from about 2 to about 30 weight percent of an overbased alkylated alkyl salicylate additive composition according to claim 4.

20. A lubricating oil composition comprising an oil of lubricating viscosity and from about 2 to about 30 weight percent of an overbased alkylated alkyl salicylate additive composition according to claim 5.

21. A lubricating oil composition comprising an oil of lubricating viscosity and from about 2 to about 30 weight percent of an overbased alkylated alkyl salicylate additive composition according to claim 6.

22. A lubricating oil composition comprising an oil of lubricating viscosity and from about 2 to about 30 weight percent of an overbased alkylated alkyl salicylate additive composition according to claim 7.

23. A lubricating oil composition comprising an oil of lubricating viscosity and from about 2 to about 30 weight percent of an overbased alkylated alkyl salicylate additive composition according to claim 8.

24. A lubricating oil composition comprising an oil of lubricating viscosity and from about 2 to about 30 weight percent of an overbased alkylated alkyl salicylate additive composition according to claim 9.

25. A lubricating oil composition comprising an oil of lubricating viscosity and from about 2 to about 30 weight percent of an overbased alkylated alkyl salicylate additive composition according to claim 10.

26. A lubricating oil composition comprising an oil of lubricating viscosity and from about 2 to about 30 weight percent of an overbased alkylated alkyl salicylate additive composition according to claim 11.

27. A lubricating oil composition comprising an oil of lubricating viscosity and from about 2 to about 30 weight percent of an overbased alkylated alkyl salicylate additive composition according to claim 12.

28. A lubricating oil composition comprising an oil of lubricating viscosity and from about 2 to about 30 weight percent of an overbased alkylated alkyl salicylate additive composition according to claim 13.

29. A lubricating oil composition comprising an oil of lubricating viscosity and from about 2 to about 30 weight percent of an overbased alkylated alkyl salicylate additive composition according to claim 14.

30. The additive composition of claim 1 wherein said composition contains greater than 0 to about 40 weight percent of said diluent.

* * * * *